United States Patent [19]

Wright et al.

[11] 4,344,833

[45] Aug. 17, 1982

[54] RESTRICTOR APPARATUS FOR ELECTROLYTE FLOW CONDUIT

[75] Inventors: David B. Wright; Sanders H. Moore, both of Cleveland, Tenn.; Morton S. Kircher, Clearwater, Fla.

[73] Assignee: Olin Corporation, New Haven, Conn.

[21] Appl. No.: 213,800

[22] Filed: Dec. 8, 1980

[51] Int. Cl.[3] ..... C25B 9/00; C25B 15/02; C25B 15/08

[52] U.S. Cl. ..... 204/258; 204/266; 204/270

[58] Field of Search ..... 204/237, 253–258, 204/267–270, 279

[56] References Cited

U.S. PATENT DOCUMENTS

| | | | |
|---|---|---|---|
| 1,660,147 | 2/1928 | Allan | 204/237 |
| 3,855,091 | 12/1974 | Piester | 204/128 |
| 3,898,149 | 8/1975 | Kircher et al. | 204/252 |
| 3,928,150 | 12/1975 | Rahn et al. | 204/98 |
| 3,928,165 | 12/1975 | Piester | 204/278 |
| 4,076,603 | 2/1978 | Andersen | 204/98 |
| 4,138,295 | 2/1979 | DeNora et al. | 204/98 |
| 4,174,266 | 11/1979 | Jeffery | 204/98 |
| 4,212,714 | 7/1980 | Coker et al. | 204/98 |
| 4,217,199 | 8/1980 | Cunningham | 204/256 |
| 4,294,683 | 10/1981 | Pere | 204/258 |
| 4,295,953 | 10/1981 | Fuseya et al. | 204/279 X |

*Primary Examiner*—Donald R. Valentine

*Attorney, Agent, or Firm*—Ralph D'Alessandro; Donald F. Clements; Thomas P. O'Day

[57] ABSTRACT

In an electrolytic filter press cell having an electrolyte fluid circulated through anode and cathode frames, a cell frame at least partially supporting an anolyte disengager and a catholyte disengager, the disengagers having at least a first flow conduit and a second flow conduit in fluid flow communication with each electrode, there is provided a variable flow restrictor in the first flow conduit from the disengagers to each electrode frame to selectively vary the flow rate of electrolyte through the disengagers to thereby control the level of foaming of the electrolyte within the disengagers to optimize the amount of gas separated out therein.

23 Claims, 3 Drawing Figures

RESTRICTOR APPARATUS FOR ELECTROLYTE FLOW CONDUIT

BACKGROUND OF THE INVENTION

The present invention relates generally to the construction of a filter press membrane electrolytic cell for the production of chlorine, alkali metal hydroxides or other caustics and hydrogen, wherein each electrolytic cell unit has at least one central electrode assembly sandwiched between at least two end electrode assemblies to form a closed system for the efficient utilization of the materials circulated therethrough. More particularly, the present invention relates to an improved electrolyte recirculation system wherein restrictor apparatus is utilized in the feed line to each electrode to selectively control the recirculation rate of the electrolyte to thereby control the level of electrolyte/gas foaming that occurs in the disengager.

As products of the electrolytic process, chlorine and caustic have become large volume commodities as basic chemicals which are an integral part of Western civilization as it is known today. The overwhelming amounts of these chemicals are produced electrolytically from aqueous solutions of alkali metal chlorides. Cells which have traditionally produced these chemicals have come to be known commonly as chlor-alkali cells. The chlor-alkalicells generally were of two principal types, the deposited asbestos diaphragm-type electrolytic cell of the flowing mercury cathode type. Comparatively recent technological advances, such as the development of the dimensionally stable anode and various coating compositions, have permitted the gaps between the electrodes to be substantially decreased and thereby dramatically increased the energy efficiency in the operation of these energy-intensive units. The development of a hydraulically impermeable membrane has promoted the advent of filter press membrane electrolytic cells which produce a relatively uncontaminated caustic product, obviating the need for caustic purification and concentration processing steps. The use of a hydraulically impermeable planar membrane has been most common in bipolar filter press membrane electrolytic cells. However, advances continue to be made in the development of monopolar filter press membrane cells.

Gas separators or disengagers have been utilized, especially in monopolar filter press membrane cells, to permit the chlorine gas to separate from the anolyte fluid during the electrolytic process. The anolyte disengager typically includes a layer of liquid anolyte along its bottom portion, a layer of foam within which various gases such as $O_2$, $CO_2$ and chlorine are present, and the separated chlorine and other gases in the top layer. Naturally, in a process designed to produce chlorine gas, efficiency of the apparatus is gauged by its ability to have the chlorine gas separate or rise up through and out of the anolyte fluid. It has been determined in testing that excessive amounts of foam in the anolyte disengager can cause carryover of foam into the gas flow lines leading to undesirable pressure surges during operation, while too little foam in the disengager may indicate that excessive chlorine gas separation is taking place within the anode chamber which may be damaging to the membranes because of the high concentration of chlorine gas within the anode and detrimental to the energy efficiency of the cell.

To control the production of gas during operation, electrolyte is circulated through a cell between the electrodes and the disengagers. It has been found that the greater the rate of recirculation of electrolyte, the greater is the amount of foam that is formed within the anolyte disengager. A similar relationship has been found to exist in the catholyte disengager between the level of foaming and the recirculation rate of the make-up water and electrolyte. By controlling the rate of flow of the electrolyte during operation, optimum efficiency of the cell can be obtained.

Under certain conditions it is desirable to be able to vary the electrolyte flow rate between the anolyte disengager and the anodes to control the level of foam build-up within the disengager. During the start-up of the cell, a period which can last from initial start-up to 12 hours, the amount of electrolyte being recirculated needs to be limited because of the high level of foaming that occurs in the disengager. Gradually, as the cell stabilizes, the electrolyte flow rate could possibly be increased. Also, variations in the current level which the cell receives during operation in response to increased or decreased production demands for caustic or chlorine, or power outages can require a change in the electrolyte flow rate during recirculation to maintain the foam build-up and chlorine gas separation at the optimum levels in the anolyte disengager. Varying levels of carbonate in the feed brine that is used as the electrolyte can substantially affect the amount of foam that is produced in the anolyte disengager. This occurs because the process generates $CO_2$ gas which bubbles up through electrodes with the other gases which are produced to contribute to the foam layer in the disengager. Further, any attempt to optimize the disengaging rate of the gas in the anolyte disengager from the anolyte fluid can require variation in the flow rate of the recirculating electrolyte fluid during operation.

Higher than normal levels of foaming can occur in the catholyte disengager during the start-up of a cell lasting from initial start-up for as long as 4 to 6 hours. Similarly to the anolyte disengager, as the cell gradually stabilizes, the electrolyte and make-up water recirculation rate could possibly be increased to optimize the rate of gas separation within the catholyte disengager.

The size of the anolyte and catholyte disengagers are a direct function of the foaming levels and amount of gas separation desired within each disengager. Where excessive foaming continually occurs, larger sized disengagers may be required. An alternative approach providing satisfactory performance can be achieved by varying the electrolyte flow rate through the cell. In fact, it is entirely possible that by varying the flow rate, smaller sized disengagers could be utilized. This is especially attractive for anolyte disengagers where the construction involves costly materials, such as titanium.

The foregoing problems are solved in the design of the apparatus comprising the present invention by providing a variable flow restrictor in the flow conduit from each gas-liquid disengager to each electrode frame to selectively vary the flow rate of the electrolyte fluid being recycled through the disengagers to each electrode to thereby control the level of foaming in the electrolyte fluid within the disengagers and thereby optimize the amount of gas separated out within the disengagers.

SUMMARY OF THE INVENTION

It is a principal object of the present invention to provide in an electrolytic filter press membrane cell a variable flow restrictor in a flow conduit connecting the anolyte or catholyte disengager and each anode or cathode, respectively, to selectively control the recirculation rate of the electrolyte within the cell.

It is another object of the present invention to prevent a blow-over of foam from either the anolyte or catholyte disengager caused by electrolyte foaming due to excessively high recirculation rates during operation.

It is a feature of the present invention that a restrictor placed within the flow conduit between the anolyte or catholyte disengager and each anode or cathode, respectively, be able to selectively adjust the electrolyte recirculation flow rate.

It is an advantage of the present invention that the variable flow restrictor is a simple and relatively inexpensive device easily utilizable in the filter press membrane cell of the present design.

It is another advantage of the present invention that the separation rate of chlorine gas within the anolyte disengager from the electrolyte fluid and the hydrogen gas from the electrolyte fluid within the catholyte disengager can be optimized despite the occurrence of conditions during operation which would normally decrease the cell's efficiency.

These and other objects, features, and advantages are obtained in an electrolytic filter press membrane cell having electrolyte fluid circulated through anode and cathode frames, with a cell frame at least partially supporting an anolyte disengager and a catholyte disengager wherein the anolyte disengager and the catholyte disengager have at least a first flow conduit and a second flow conduit in fluid flow communication with each anode and cathode, respectively, by providing a variable flow restrictor within the first flow conduit from the appropriate disengager to each electrode frame to selectively vary the flow rate of electrolyte through the anolyte disengager and the catholyte disengager to thereby control the level of foaming in both the anolyte within the anolyte disengager and the catholyte within the catholyte disengager to optimize the amount of gas separated out.

DETAILED DESCRIPTION OF THE PREFERRED EMBODIMENT

Figure 1:
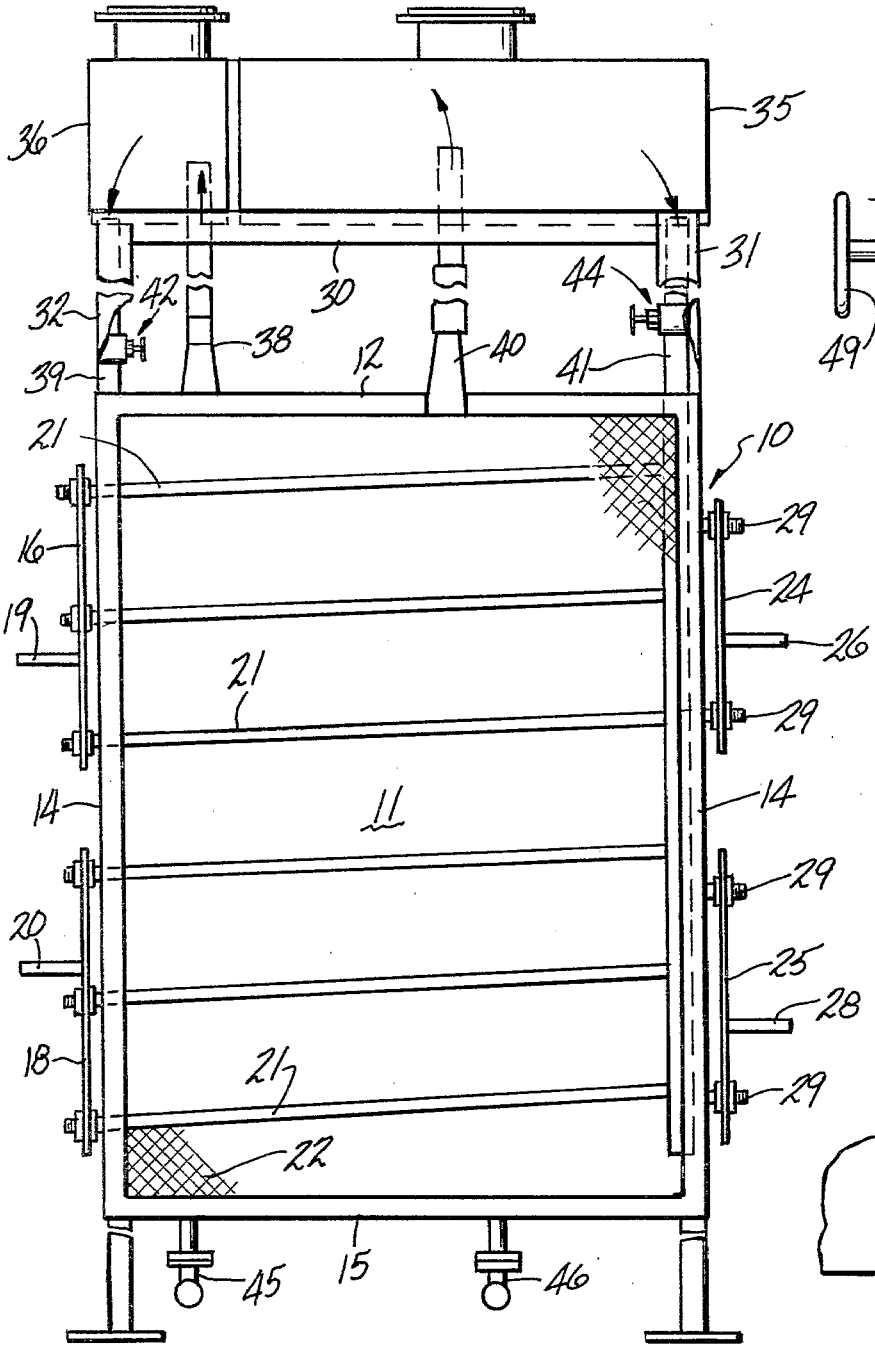
FIG. 1 is a side elevational view of a filter press membrane cell with the cell frame broken away to show the anolyte and catholyte disengagers mounted atop the electrode frame and connecting to the alternating cathode and anode electrodes via risers and downcomers having the anode as the electrode closest to the viewer.

Referring to FIG. 1 there is shown in side elevation a view of a typical electrochemical cell 10 looking at an anode frame 11 as the closest electrode to the viewer. Frame 11 is seen comprising a top channel 12, two opposing side channels 14, and a bottom channel 15. Upper anode collector 16 and lower anode collector 18 are appropriately joined to upper anode terminal 19 and lower anode terminal 20, respectively. Anode conductor rods 21 extend into the anode compartment formed between the opposing anode surfaces 22, only one of which is shown. On the opposing side of the cell 10 is shown the upper cathode collector 24 and lower cathode collector 25 appropriately connected to the upper cathode terminal 26 and the lower cathode terminal 28, respectively. Extending inwardly into the cathode compartment (not shown) is a plurality of cathode conductor rods 29, appropriately secured to the upper cathode collector 24 and the lower cathode collector 25.

Shown mounted to the top of cell 10 via disengager horizontal support 30, disengager vertical supports 31, 32, and cell horizontal frame support beams (not shown) are the anolyte disengager 35 and catholyte disengager 36. A plurality of fluid flow conduits connect the disengagers to their appropriate electrodes. Catholyte riser 38 carries the catholyte fluid up into the disengager from the cathode frame (not shown), while the cathode downcomer or return line 39 returns the catholyte fluid into the cathode frame. Similarly, the anolyte disengager 35 is connected to the anode frame 11 via an anolyte riser 40 and an anolyte downcomer or return line 41. Restrictor means 42 and 44, in the forms of valves, are shown in the catholyte downcomer line 39 and the anolyte downcomer line 41, respectively. These will be described in further detail hereafter.

The cell 10 also has a catholyte drain 46 in the bottom of each cathode (not shown) and an anolyte drain 45 projecting from the underside of bottom channel 15 of each anode frame 11 of the cell. The cell 10 has been described only generally since the structure and the function of its central components are well known to one skilled in the art. A more detailed and thorough description of the filter press membrane cell 10 is formed in U.S. patent application Ser. No. 128,684, filed Mar. 10, 1980, assigned to the assignee of the present invention, and hereinafter specifically incorporated by reference in pertinent part insofar as it is consistent with the instant disclosure.

Figure 2:
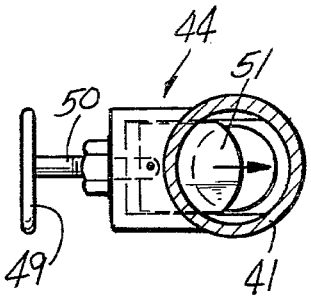
FIG. 2 is an enlarged top plan view of a downcomer leading from the anolyte disengager to an anode with a gate valve provided to restrict the anolyte flow.

Referring now to FIG. 2, there is shown a top plan view of the anolyte restrictor means 44 mounted to the anolyte downcomer 41. As can be seen, restrictor means 44 is in the form of a gate valve having a handle 49 which is appropriately connected to a threaded spool 50 that connects to the gate 51. As can be seen, this type of a valve is commonly utilized in liquid flow lines so that the handle 49 can be turned to cause the spool 50 to move inwardly, forcing the gate 51 to restrict the opening within the downcomer 41 to decrease the flow rate of anolyte fluid through the disengager 35.

Figure 3:
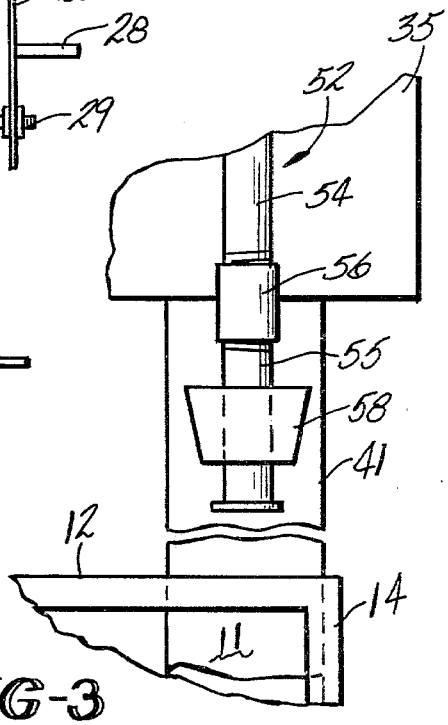
FIG. 3 is an enlarged side elevational view of an alternate embodiment partially diagramatically showing restrictor apparatus placed within the downcomer to restrict the anolyte flow.

Since it has been found that the foam level in the anolyte disengager 35 can be appreciably reduced by reducing the recirculation flow rate, alternate flow restrictor means have been attempted. Such apparatus is shown in FIG. 3 wherein a portion of the anolyte disengager 35 is shown connected to top channel 12 of anode frame 11 by the anolyte downcomer 41. In this embodiment fresh electrolyte feed line 52 is shown extending from within the disengager 35 towards the anode frame 11. The feed line 52 is comprised of a first part 54 which is connected to the electrolyte manifold (not shown) and a second portion 55. The first portion 54 and the second portion 55 are connected by an appropriate coupling 56. A restrictor in the form of the arcuately surfaced or frusto-conical plug 58 is fastened about the second portion of the feed line 55. If necessary, plug 58 can be replaced with a larger or smaller diameter restrictor plug, dependent upon the needs of the operating situation, to achieve the optimum anolyte recirculation versus the desired foaming level. Plug 58 effectively reduces the cross-sectional area without the downcomer 41 available for anolyte fluid recirculation. This decreases the anolyte flow through the disengager, effectively extending the amount of time the fluid must spend in the disengager and thereby maximizing the chlorine gas separation from the fluid.

While the instant invention has been discussed only in terms of the anolyte disengager 35 and the anolyte downcomer or return line 41, it should be noted that the foaming level is also an operational problem in the catholyte disengager 36. Excessive foaming within the catholyte disengager 36 reduces the efficiency of the gas-liquid separation that occurs therein during operation. Accordingly, a similar type of restrictor means to that shown in detail in either FIGS. 2 or 3 could be employed in the catholyte downcomer line 39 as indicated in FIG. 1.

In operation, appropriate electrolyte fluid is circulated through the anode and cathode compartments of the anode and cathode frames which are arranged in alternating manner in the electrochemical cell 10. The electrolyte fluid is circulated so that from the cathode frame (not shown) the electrolyte fluid with entrained hydrogen gas and the appropriate caustic or alkali metal hydroxide rise up through riser 38 into the catholyte disengager 36. Within the disengager the entrained hydrogen gas separates from the electrolyte fluid, commonly known as a catholyte, and exits the catholyte disengager 36 through an appropriate conduit to a gas handling system. The catholyte is recycled into the cathode frame by passing through a downcomer 32 on which a catholyte restrictor means 42 is appropriately mounted.

Similarly, electrolyte is permitted to circulate into the anolyte disengager 35 by rising up the anolyte riser 40 into the disengager 35 where the entrained chlorine gas bubbles are permitted to separate from the foaming anolyte fluid. The chlorine gas then passes into an appropriate conduit and into the chlorine gas handling system. The anolyte fluid is recirculated down into each anode frame 11 via the anolyte downcomer 41. Appropriately mounted in the downcomer 41 is an anolyte restrictor means 44.

Electrical power is supplied to the cell 10 from an external power source. The current is conducted into each cathode frame via the upper and lower cathode terminals 26 and 28, the upper and lower cathode collectors 24 and 25, and the cathode conductor rods 29 to supply the energy necessary for electrolysis. Similarly, for each anode frame the current is conducted into the compartment formed by the frame 11 and the opposing surfaces 22 via the upper and lower anode terminals 19 and 20, the upper and lower anode collectors 16 and 18, and the anode conductor rods 21 to supply the energy necessary to promote the anodic electrolytic reactions within the cell 10. While the electrical current is thus conducted through the cell 10, the appropriate electrolyte fluid is circulated through each anode and cathode frame as described above.

Both the catholyte restrictor means 42 and the anolyte restrictor means 44 operate to control the amount of cross-sectional area available for electrolyte fluid flow in their respective downcomer or return lines 39 and 41. This varying of the cross-sectional area within each downcomer controls the recirculation flow rate of the electrolyte between the appropriate disengager and electrode. The level of foaming that occurs within each disengager is a direct function of the flow rate of the catholyte fluid or the anolyte fluid through the appropriate disengager. By restricting the cross-sectional area in the appropriate downcomer line, the recirculation flow rate is decreased so that the foam level is decreased in the anolyte or catholyte fluid, as appropriate. Thus, by varying the cross-sectional area available for flow of both the anolyte downcomer 41 and the catholyte downcomer 39, the level of foam build-up in the appropriate disengager can be controlled despite variations in operating conditions that otherwise may negatively affect the operating efficiency of the electrochemical cell 10.

While the preferred structure in which the principles of the present invention have been incorporated is shown and described above, it is to be understood that the invention is not to be limited to the particular details thus presented, but in fact, widely different means may be employed in the practice of the broader aspects of this invention. For example either one or both of the catholyte restrictor means 42 and anolyte restrictor means 44 may be coupled to actuator apparatus which responds to sensing apparatus that monitors one or more operating conditions within the cell 10. The actuator apparatus could then automatically adjust the appropriate restrictor means to correct the sensed condition within the cell. Also, although the apparatus has been described in the context of a chlor-alkali cell utilizing a salt brine and sodium base caustic, it is to be understood that the invention is equally well adaptable to cells producing potassium hydroxide as the caustic. The scope of the appended claims is intended to encompass all obvious changes in the details, materials and arrangements of parts which will occur to one of skill in the art upon a reading of the disclosure.

Having thus described the invention, what is claimed is:

1. In an electrolytic filter press cell having electrolyte circulated through anode and cathode frames, an anolyte disengager and a catholyte disengager to remove gases from the anolyte and the catholyte fluids, at least a first flow conduit and a second flow conduit in fluid flow communication with each anode and the anolyte disengager, the improvement comprising in combination:

(a) a feed pipe extending from the anolyte disengager within the first flow conduit a predetermined distance to inject concentrated electrolyte into each anode; and (b) variable flow restrictor means in the first flow conduit from the anolyte disengager to each anode frame cooperative with the feed pipe to selectively vary the flow rate of electrolyte through the anolyte disengager to thereby control the level of forming in the anolyte within the anolyte disengager to optimize the amount of gas separated out within the anolyte disengager.

2. In an electrolytic filter press cell for the production of certain gases and caustic from fluid electrolyte which passes through the cell along a predetermined path comprising:

(a) a supporting frame;

(b) a plurality of generally elongate cathodes supported generally vertically within the frame through which electrolyte travels along the predetermined path;

(c) a plurality of generally elongate anodes generally parallel to the cathodes sandwiched therebetween and supported within the frame through which electrolyte passes along the predetermined path;

(d) an anolyte disengager connected to the frame containing an anolyte fluid in fluid flow communication with the anodes to permit gas to separate from the anolyte;

(e) at least a first fluid flow conduit and a second fluid flow conduit connecting the anolyte disengager to each of the anodes;

(f) a catholyte disengager connected to the frame containing a catholyte fluid in fluid flow communication with the cathodes effective to permit gas to separate from the catholyte;

(g) fluid flow conduit means connecting the catholyte disengager to each of the cathodes;

(h) electrical conducting means connected to the anodes and cathodes for conducting electric power therebetween;

(i) a feed pipe extending from the anolyte disengager within the first flow conduit a predetermined distance to inject concentrated electrolyte into each anode;

(j) an electric power source connected to the cell for powering the electrochemical reaction; and (k) variable flow restrictor means cooperative with the first fluid flow conduit and the feed pipe to selectively control the rate of flow of anolyte through the anolyte disengager to thereby control the level of foaming in the anolyte disengager and optimize the separation gas from the anolyte.

3. The apparatus according to claims 1 or 2 wherein the first flow conduit further comprises a predetermined cross-sectional area available for fluid flow between the anolyte disengager and each anode.

4. The apparatus according to claim 3 wherein the restrictor means is adjacent the feed pipe to thereby selectively increase or decrease the cross-sectional area of the first flow conduit available for fluid flow.

5. The apparatus according to claim 3 wherein the restrictor means further is mounted to the feed pipe to selectively increase or decrease the cross-sectional area available for fluid flow.

6. The apparatus according to claim 3 wherein the restrictor means further comprises valve means integral with the first flow conduit effective to selectively vary the flow rate.

7. The apparatus according to claims 1 or 2 wherein the restrictor means is further manually adjustable.

8. The apparatus according to claim 7 wherein the restrictor means further comprises a valve means.

9. In an electrolytic filter press cell having an electrolyte circulated through a plurality of electrodes, the electrodes being arranged as alternating anode and cathode frames separated by an ion selectively permeable membrane, a gas-liquid disengager connected to each electrode to remove gas from the foaming electrolyte, at least a first flow conduit and a second flow conduit in fluid flow communication with each electrode and disengager, the improvement comprising:

variable flow restrictor means in the first flow conduit from the disengager to the corresponding electrode frame and automatically adjustable in response to at least one sensed operating condition to selectively vary the flow rate of electrolyte through the disengager to thereby control the level of foaming of the electrolyte within the disengager to optimize the amount of gas separated out within the disengager.

10. The apparatus according to claim 9 wherein the variable flow restrictor means is located in the first flow conduit connecting an anode to the anolyte disengager.

11. The apparatus according to claim 9 wherein the variable flow restrictor means is located in the first flow conduit connecting a cathode to the catholyte disengager.

12. The apparatus according to claims 10 or 11 wherein the first flow conduit further comprises a predetermined cross-sectional area available for eletrolyte fluid flow therethrough.

13. The apparatus according to claim 12 wherein the restrictor means is adjacent a feed pipe for injecting electrolyte into the electrode which extends from the gas-liquid disengager within the first flow conduit a predetermined distance to thereby selectively increase or decrease the cross-sectional area of the first flow conduit available for electrolyte fluid flow.

14. The apparatus according to claim 12 wherein the restrictor means further is mounted to the feed pipe to selectively increase or decrease the cross-sectional area available for electrolyte fluid flow.

15. The apparatus according to claim 12 wherein the restrictor means further comprises valve means integral with the first flow conduit effective to selectively vary the flow rate of electrolyte fluid therethrough.

16. The apparatus according to claim 9 wherein the restrictor means is further manually adjustable.

17. In an electrolytic filter press cell having electrolyte circulated through anode and cathode frames, an anolyte disengager and a catholyte disengager to remove gases from the anolyte and the catholyte fluids, at least a first flow conduit and a second flow conduit in fluid flow communication with each anode and the anolyte disengager, the improvement comprising:

variable flow restrictor means in the first flow conduit from the anolyte disengager to each anode frame automatically adjustable to at least one sensed operating condition to selectively vary the flow rate of electrolyte through the anolyte disengager to thereby control the level of foaming in the anolyte within the anolyte disengager to optimize the amount of gas separated out with the anolyte disengager.

18. In an electrolytic filter press cell for the production of certain gases and caustic from fluid electrolyte which passes through the cell along a predetermined path comprising:

(a) a supporting frame;

(b) a plurality of generally elongate cathodes supported generally vertically within the frame through which electrolyte travels along the predetermined path;

(c) a plurality of generally elongate anodes generally parallel to the cathodes sandwiched therebetween and supported within the frame through which electrolyte passes along the predetermined path;

(d) an anolyte disengager connected to the frame containing an anolyte fluid in fluid flow communication with the anodes to permit gas to separate from the anolyte;

(e) at least a first fluid flow conduit and a second fluid flow conduit connecting the anolyte disengager to each of the anodes;

(f) a catholyte disengager connected to the frame containing a catholyte fluid in fluid flow communication with the cathodes effective to permit gas to separate from the catholyte;

(g) fluid flow conduit means connecting the catholyte disengager to each of the cathodes;

(h) electrical conducting means connected to the anodes and cathodes for conducting electrical power therebetween;

(i) an electric power source connected to the cell for powering the electrochemical reaction; and (j) variable flow restrictor means cooperative with the first fluid flow conduit and automatically adjustable in response to at least one sensed operating condition to selectively control the rate of flow of anolyte through the anolyte disengager to thereby control the level of foaming in the anolyte disengager and optimize the separation gas from the anolyte.

19. The apparatus according to claims 17 or 18 wherein a feed pipe extends from the anolyte disengager within the first flow conduit a predetermined distance to inject concentrated electrolyte into each anode.

20. The apparatus according to claim 19 wherein the restrictor means is adjacent the feed pipe to thereby selectively increase or decrease the cross-sectional area of the first flow conduit available for fluid flow.

21. The apparatus according to claim 19 wherein the restrictor means further is mounted to the feed pipe to selectively increase or decrease the cross-sectional area available for fluid flow.

22. The apparatus according to claim 19 wherein the restrictor means further comprises valve means integral with the first flow conduit effective to selectively vary the flow rate.

23. The apparatus according to claims 17 or 18 wherein the first flow conduit further comprises a predetermined cross-sectional area available for fluid flow between the anolyte disengager and each anode.

* * * * *

UNITED STATES PATENT AND TRADEMARK OFFICE

CERTIFICATE OF CORRECTION

PATENT NO. : 4,344,833

DATED : August 17, 1982

INVENTOR(S) : Wright et al.

It is certified that error appears in the above-identified patent and that said Letters Patent is hereby corrected as shown below:

Column 1, line 30, "of" should read --or--.

Column 4, line 38, "formed" should read --found--.

Column 5, line 6, "without" should read --within--.

Column 6, line 59, "forming" should read --foaming--.

Column 8, line 14, "eletrolyte" should read --electrolyte--.

Signed and Sealed this

First Day of March 1983

[SEAL]

*Attest:*

GERALD J. MOSSINGHOFF

*Attesting Officer*

*Commissioner of Patents and Trademarks*